United States Patent [19]

Ping, III et al.

[11] Patent Number: 4,733,774

[45] Date of Patent: Mar. 29, 1988

[54] GLUE PATTERNED SUBSTRATE FOR POUCHED PARTICULATE FABRIC SOFTENER LAUNDRY PRODUCT

[75] Inventors: Vernon S. Ping, III, Cincinnati; Eric E. Beard, West Chester, both of Ohio

[73] Assignee: The Procter & Gamble Company, Cincinnati, Ohio

[21] Appl. No.: 5,802

[22] Filed: Jan. 16, 1987

[51] Int. Cl.[4] ..... C11D 17/00; D06M 13/46

[52] U.S. Cl. ..... 206/0.5; 8/137; 68/13 A; 252/90; 427/242

[58] Field of Search ..... 206/0.5, 524.6, 524.2; 8/137; 34/9, 12, 60; 68/17 R, 13 A; 252/8.6, 8.8, 90, 92, 93, 174; 383/1; 428/195; 427/242

[56] References Cited

U.S. PATENT DOCUMENTS

| | | | |
|---|---|---|---|
| 3,948,387 | 4/1976 | Haertle | 206/0.5 |
| 4,108,600 | 8/1978 | Wong | 8/137 |
| 4,113,630 | 9/1978 | Hagner et al. | 252/8.6 |
| 4,114,284 | 9/1978 | Weber et al. | 34/12 |
| 4,223,029 | 9/1980 | Mahler et al. | 427/242 |
| 4,259,383 | 3/1981 | Eggensperger et al. | 428/72 |
| 4,348,293 | 9/1982 | Clarke et al. | 252/90 |
| 4,410,441 | 10/1983 | Davis et al. | 206/0.5 |
| 4,433,783 | 2/1984 | Dickinson | 206/484 |
| 4,555,354 | 11/1985 | Clarke et al. | 252/92 |
| 4,571,924 | 2/1986 | Bahrani | 53/453 |
| 4,638,907 | 1/1987 | Bedenk et al. | 206/0.5 |

FOREIGN PATENT DOCUMENTS

| | | |
|---|---|---|
| 66463 | 12/1982 | European Pat. Off. . |
| 1298454 | 12/1972 | United Kingdom . |

*Primary Examiner*—Jimmy G. Foster

*Attorney, Agent, or Firm*—Leonard Williamson; Richard C. Witte

[57] ABSTRACT

Disclosed is a through-the-wash and dryer laundry product which comprises:

(a) a water-permeable, water-insoluble substrate;

(b) a particulate fabric softener for release in the dryer, said softener enclosed within a pouch made of the substrate; wherein (c) the substrate has on its surface a water-insoluble, spaced-apart glue pattern adapted to reduce fabric softener staining when the product is used in the dryer.

10 Claims, 4 Drawing Figures

GLUE PATTERNED SUBSTRATE FOR POUCHED PARTICULATE FABRIC SOFTENER LAUNDRY PRODUCT

FIELD OF THE INVENTION

This invention relates to substrates used to enclose particulate fabric softener for through-the-wash and dryer laundry products.

BACKGROUND OF THE INVENTION

This invention relates to pouched laundry products which contain fabric softener particles for through-the-wash and dryer use.

Pouched Fabric Softener Laundry Products

When, for example, loose through-the-wash-and-rinse fabric softener particles are added to the wash step of a laundering process, it is inevitable that some of the particles will not adhere to or become trapped in the folds of the fabrics and will, therefore, be lost in the discarded wash solution or rinse water. In order to avoid such loss, the softener particles can be added to the wash solution in a sealed, porous water-insoluble pouch such as the types described in U.S. Pat. Nos. 4,571,924, Bahrani, issued Feb. 25, 1986, and 4,223,029, Mahler et al., issued Sept. 16, 1980, both incorporated herein by reference. Detergent granules are usually included in the pouch with the softener particles. When the pouch is placed in water in the wash step of the laundering process, the detergent dissolves, but the softener particles remain in the pouch through the wash and rinse. When the pouch is tumbled with the fabrics in the dryer, the softener particles melt onto the pouch material and the softener is transferred from the pouch material to the fabrics as the pouch comes into contact with the fabrics during the drying cycle.

Softener staining is an insidious problem in the art of dryer-added fabric softeners. This problem in pouched through-the-wash and dryer products with loose softener particles is even more so. The present invention is designed to reduce or substantially eliminate the softener staining problem in such products.

Various solutions to such softener staining have been proposed in the art. U.S. Pat. No. 4,113,630, Hagner et al., issued Sept. 12, 1978, discloses a through-the-wash laundry article utilizing a water-insoluble substrate in which laundry actives are enclosed and the fabric softener is in the form of immobilized softener dots raised above the surface of the substrate. U.S. Pat. No. 4,108,600, Wong, issued Aug. 22, 1978, discloses a pouched laminated through-the-wash laundry product having an additional wall placed in between the walls of the pouch to split it in two. Into one half is placed specially coated fabric softener particles and an electrolyte/pH control agent is placed in the other half. Wong uses in his example a plain polyester non-woven ply material as the inner wall material.

Other references of interest are the pouched laundry articles in general. GB patent specification No. 1,298,454, Atkins, published Dec. 6, 1972, discloses a packaged washing powder in a water-permeable bag. The bag contains a thermal plastic, discontinuous surface coating apparently for "heat sealing." Fabric softener particles are not mentioned in GB No. 1,298,454. U.S. Pat. No. 4,348,293, Clarke et al., issued Sept. 7, 1982, discloses a water-insoluble, water-permeable bag having a water-soluble or water-dispersible protective layer and containing a particulate detergent composition. U.S. Pat. No. 4,410,441, Davis et al., issued Oct. 18, 1983, discloses laminating two different materials into two large pouches. Typically, dry powders are laminated between a water-permeable substrate and a water-impermeable substrate. U.S. Pat. Nos. 4,259,383, Eggensperger et al., issued Mar. 31, 1981; 4,433,783, Dickinson, issued Feb. 28, 1984; and EPA 66,463, Haq (Unilever NV), Dec. 8, 1982, all incorporated herein by reference, are also background references.

Preferred pouch structures are multi-pouch porous sheet structures such as described in U.S. Pat. Nos. 4,571,924, supra; 4,638,907, Bedenk et al., issued Jan. 27, 1987; and 4,259,383, supra; all incorporated herein by reference. In a single pouch structure, the softener particles tend to collect in a relatively small area of the structure, whereas in a multi-pouch sheet structure the softener particles are distributed over a larger area of the structure thereby facilitating more even transfer of softener to fabrics in the dryer.

Selected fibrous substrates improve the release of fabric softener in a pouched granular detergent/softener product form over one made with an all cellulosic paper substrate.

OBJECTS OF THE INVENTION

It is an object of the present invention to provide a reduced softener staining means for pouched laundry products containing loose softener particles.

It is also an object of the present invention to provide a through-the-wash pouched laundry product with improved softener delivery manifested by reduced softener staining in the dryer.

Another object of the present invention is to make a compact and efficient laminated through-the-wash laundry fabric softener product which is efficient in the dryer.

Yet another object of the present invention is to incorporate into a laminated through-the-wash laundry product a means to improve fabric softener particle delivery manifested by reduced staining.

Still another object of the present invention is to provide reduced softener staining for through-the-wash laminates containing softener particles.

Another object of the present invention is to provide a superior laminated through-the-wash laundry product for consumer use which contains an effective amount of laundry actives including fabric softeners in a convenient sheet or pouched form.

Other objects will become apparent from the following disclosure.

SUMMARY OF THE INVENTION

The present invention is a through-the-wash and dryer laundry product which comprises:

(a) a water-permeable, water-insoluble substrate;

(b) a particulate fabric softener within an enclosed pouch made of the substrate for release in the dryer; wherein (c) the substrate has on its surface a water-insoluble, spaced-apart glue pattern adapted to reduce fabric softener staining when the product is used in the dryer.

DETAILED DESCRIPTION OF THE INVENTION

The spaced-apart glue patterned substrate is used to pouch (contain) loose softener particles for a softener staining control improvement. The spaced-apart printed glue pattern on the substrate provides an improvement in softener release from the substrate in the dryer. While not being bound by any theory, it is believed that the spaced-apart glue pattern on the substrate acts as a thermo heat sink which helps to control the rate of release of softener via spreading the molten softener particles more evenly across the pouched sheet. The term "heat sink" as used herein is defined as a device for the absorption and dissipation of heat and molten fabric softener in the dryer. The spaced-apart glue patterned substrate helps to prevent softener staining in the dryer. The spaced-apart glue pattern printed on the outside surface of the substrate of the pouched product also reduces softener staining, and virtually eliminates certain fibrous substrates from "pilling." The fabric softener staining benefit is realized if the glue pattern printed on either the inside surface or the outside surface of the substrate. The spaced-apart glue pattern can also be impregnated well into the substrate itself, from outside to inside surfaces wherein both reduced pilling and improved softener staining benefits can be realized.

Unless otherwise specified, the terms "glue" and "adhesive" as defined herein mean a water-insoluble thermoset or thermoplastic material, e.g., polyolefins, polyesters and other polyamides; or solvent based adhesives, which are water-insoluble when cured, and the like.

Any coating of insoluble glue cuts down on the porosity of the substrate. To insure porosity a spaced-apart glue pattern is used. This spaced-apart pattern leaves open areas which can range from about 30% to about 99% on the sheet surface and thereby maintains the porosity of the substrate needed for certain pouched laundering active solubility. Preferably the open areas range from about 50% to 97%, and more preferably from about 70% to about 95%. The glue pattern would occupy the balance of the substrate surface area. Thus, the corresponding glue occupied surface area ranges are from about 1% to about 70%, more preferably from about 3% to about 50%, and most preferably from about 5% to about 30%. There is a direct relationship between the amount of open area of the substrate and its porosity. Generally, the glue is applied to concentrate its weight on the line so as to maintain substrate porosity while improving the softener delivery.

The glue is applied to the substrate at a level of from about 3 to about 150 grams, preferably from about 5 to about 65 grams, and most preferably from about 10 to about 50 grams per square meter of substrate.

DETAILED DESCRIPTION OF THE DRAWINGS

Figure 1:
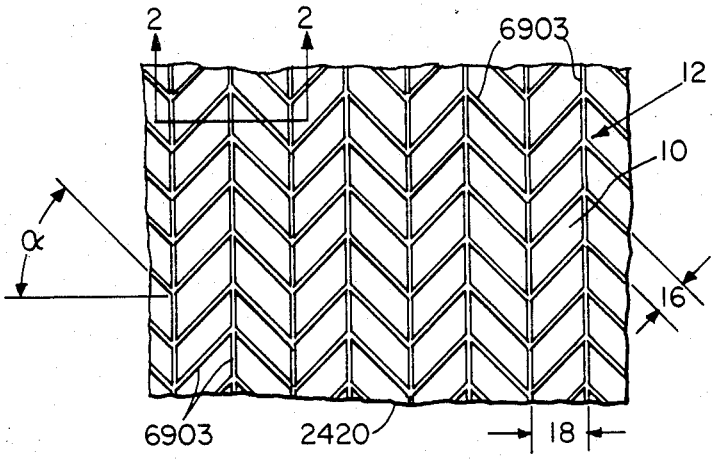
FIG. 1 shows a substrate section having a spaced-apart herringbone pattern of glue which is applied to one of its surfaces.

FIG. 1 shows a section of substrate 2420 having a spaced-apart herringbone pattern 12 of glue 6903. The distances 18 between the vertical lines of glue 6903 are about 0.222 inch (0.56 cm) and the distances 16 between the 45° alpha angled glue 6903 lines are about 0.11 inch (0.28 cm). There are unglued substrate spaces 10 in between the glue patterned 12 lines. The other dimension and characteristics of substrate 2420 are shown in Table 1.

Figure 2:
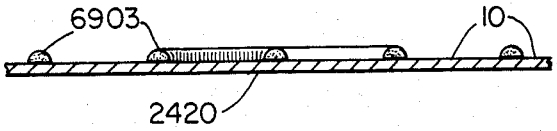
FIG. 2 is a cross-sectional view through the spaced-apart herringbone pattern with glue of FIG. 1.

FIG. 2 is a cross-sectional view of FIG. 1 through lines 2—2. Glue 6903 is shown raised, but can be impregnated into substrate 2420 by rolls or vacuum when the glue is hot using techniques known in the art.

Figure 3:
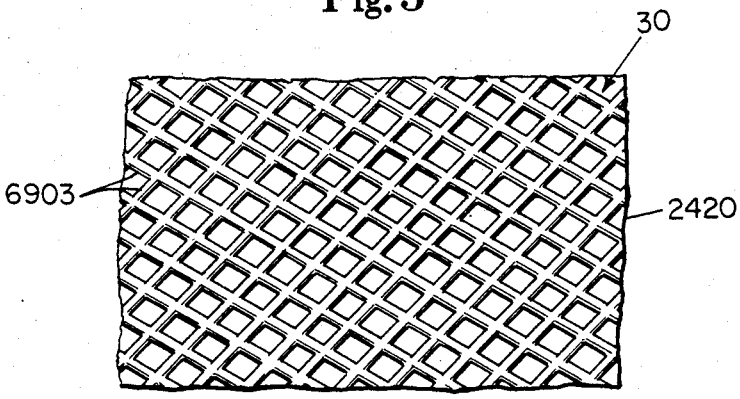
FIG. 3 is a substrate section having a spaced-apart No. 10 diamond crosshatch pattern of glue.

FIG. 3 is another example of a sectional view of a spaced-apart No. 10 diamond crosshatch pattern 30 of glue on a substrate 2420.

Figure 4:
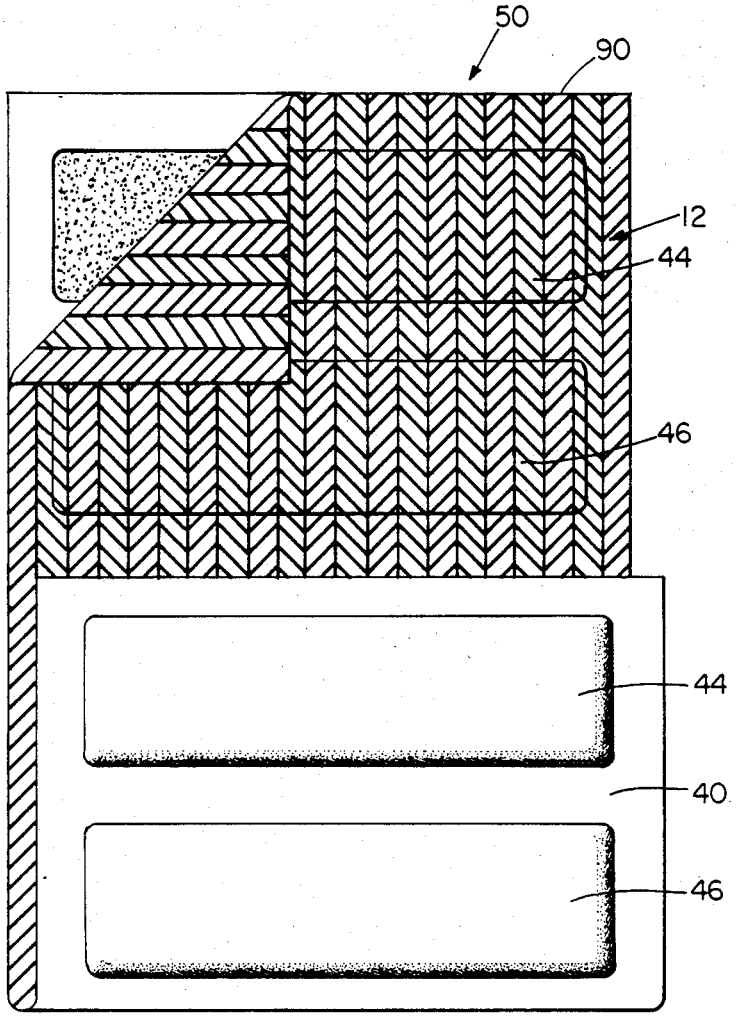
FIG. 4 shows a 6-celled laminated, multi-pouched, multi-action laundry product.

FIG. 4 is a top and bottom view of a folded, laminated, 6-multi-pouched laundry product sheet 50. Particulate softener particles are contained throughout the 6-multi-pouched sheet. The product sheet 50 has two mini-pouches (cells) of softener/bleach (whiteners and stain removers) 44; one on each end of product sheet 50. A corner of one cell 44 is peeled back. When the glue is colored, the glue pattern 12 can be seen through this substrate. The product sheet 50 also has four cells of softener/detergent 46. The top unembossed sheet substrate 90 is shown with the spaced-apart herringbone glue pattern 12. Two cells of the softener/detergent 46 are covered over (hence, not shown) because two cells are folded over them to show the embossed bottom sheet 40, which has no spaced-apart glue pattern.

The Spaced-Apart Hot Melt Glue Patterned Printing Process

This system of making a substrate of this invention can be broken down into three parts: (1) the general printing process or method, (2) the spaced-apart printed pattern itself, and (3) the glue or adhesive. It should be noted that the following system (the hot melt glue patterned printing process, the herringbone pattern or the Henkel 6903 adhesive) is only one of many systems that can be used to make the spaced-apart glue patterned substrate of this invention. The total system and its parts are intended to be nonlimiting examples.

The hot melt glue pattern can be printed with a Thermo Intaglio Graphics process with a rotogravure hot melt system such as manufactured by Roto-Therm, Inc., Anaheim, Calif. 92807. The illustrated (FIG. 1) printed pattern is a spaced-apart herringbone pattern. A preferred adhesive (glue) is a polyamide adhesive sold under the trade name of Henkel 6903. When cured it is water insoluble.

The gravure system consists of an engraved roll that can be engraved to almost any spaced-apart pattern, a silicon rubber back-up roll and a doctor blade assembly that wipes the gravure roll and meters the adhesive. The amount of adhesive printed is primarily determined by the engraved spaced-apart pattern cut into the gravure roll. The substrate is passed through a nip between the gravure roll and back-up roll at which point the molten adhesive is transferred to the substrate. Preferably, the adhesive is then pressed into the substrate in another nip and then cooled, cured and rewound for use in the final product.

This rotogravure printing method is only one of many that could be used. Other methods that could be used include flexographic offset printing and screen printing techniques. Laboratory bench scale methods such as screen and engraved plate transfer can also be used. An infinite number of spaced-apart glue patterns could be used on the substrates, as long as the spaced-apart pattern is spread in such a way so as to provide reduced staining in the distribution of the melted softener particles in the dryer.

The illustrated spaced-apart glue pattern 12 is the herringbone pattern shown in FIG. 1. This is how it appears to scale on a preferred patterned substrate itself, as well as on the rotogravure cylinder used to print the hot melt. This herringbone pattern is engraved into the gravure cylinder such that it delivers an average of 19.3 grams ±1 gram of glue per square meter of substrate. The engraved pattern is made up of short zigzag 45° angle (alpha) lines that are 0.32 inch (0.81 cm) long, 0.010 inch (0.025 cm) wide and 0.009 inch (0.023 cm) deep (FIG. 1). A preferred adhesive is a polyamide hot melt adhesive (Henkel 6903 made by the Henkel Co.). Another preferred adhesive is HA8661 (Coscomelt, an ethyl vinyl acetate (EVA) made by Borden Chemical Co.). Any other compatible, water-insoluble adhesive or glue can be used. Other suitable hot melt adhesives include: polyolefin, polyesters and other polyamides, all of which are printable, water-insoluble, thermo plastics. The densities of hot melt adhesives can range from 0.75 to 1.35 gram/cubic centimeters. The term "insoluble glue" as used herein means that it maintains its integrity through the laundering process and preferably has a solubility in 49° C. water of less than 10%, preferably 5% or less, and more preferably 3% or less.

Solvent-based adhesives can also be used to reduce softener staining in the products of the present invention, as long as they satisfy the basic requirements of washer and dryer survivability. However, the curing stage of solvent-based adhesives generally requires high temperatures to drive off the solvents. The major advantage of using hot melt adhesives is that they are cured solid by cooling to room temperature. Thus, the latter is more preferred.

The preferred substrates are fibrous subrates made from polyesters, polyolefins, nylons, rayons, cellulose, mixtures thereof, and the like. The substrates can include staple fibers and continuous fibers. The glue pattern of the present invention can prevent some of such substrates from pilling in a normal wash environment, as well as reduce fabric softener staining. An example of a preferred nonpilling fibrous substrate is Kiara® 9116, a 1.3 oz. basis weight of carded polyethylene/-polyester bicomponent fibers, commercially available from Chicopee Corporation. It is essential that the substrate or substrates used are compatible for laundry and dryer use.

The top sheet of a two ply laminated pouch can be made of any suitable pouch substrate material including paper, nonwoven synthetics such as spunbonded polyester, porous formed film plastic sheet material and combinations thereof. A suitable top sheet ply is made of a strengthened tissue similar to the one described in Example II of allowed U.S. patent application Ser. No. 748,654, Strampach et al., filed June 25, 1985, incorporated herein by reference in its entirety.

The typical properties of some preferred substrates are set out in Table 1.

TABLE 1

Typical Physical Properties* of REEMAY ® Spunbonded Polyester

| Style | Unit Weight oz/yd² | Unit Weight g/m² | Thickness mils | Sheet Grab Tensile MD lbs. | Sheet Grab Tensile XD lbs. |
|---|---|---|---|---|---|
| 2200 | 1.0 | 34 | 7 | 21 | 19 |
| 2214 | 1.35 | 50 | 10 | 33 | 34 |
| 2295 | 2.95 | 100 | 18 | 73 | 70 |
| 2410 | 1.15 | 39 | 11 | 14 | 11 |
| 2415 | 1.55 | 53 | 14 | 22 | 16 |
| 2420 | 1.85 | 63 | 15 | 28 | 22 |
| 2430 | 2.4 | 81 | 17 | 39 | 32 |
| 2440 | 2.9 | 98 | 18 | 51 | 45 |

TABLE 1-continued

Typical Physical Properties* of REEMAY ® Spunbonded Polyester

| Style | Trapezoid Tear MD lbs. | Trapezoid Tear XD lbs. | Mullen Burst psi | Mullen Burst kPa | Frazier Air Perm. @ 0.5" $H_2O$ |
|---|---|---|---|---|---|
| 2200 | 7 | 8 | 15 | 103 | 650 |
| 2214 | 11 | 11 | 34 | 234 | 525 |
| 2295 | 16 | 17 | 76 | 524 | 300 |
| 2410 | 6 | 6 | 9 | 62 | 975 |
| 2415 | 11 | 9 | 16 | 110 | 700 |
| 2420 | 13 | 11 | 18 | 124 | 650 |
| 2430 | 17 | 14 | 29 | 200 | 425 |
| 2440 | 19 | 16 | 38 | 262 | 350 |

*These are typical properties and should be used as a guide only.
Note:
REEMAY ® is a registered trademark of the DuPont Company, Wilmington, Delaware. The above data are published in one of DuPont's bulletins. Styles are subject to change. The above data are reported as average properties.

The present invention comprises a glue patterned coated fibrous substrate for a laminated, pouched, or bagged through-the-wash laundry product. The pouch or bag contains a pre-measured, single use amount and releases them at the desired point in the dryer cycle. The substrate of this invention may also be used to separate or compartmentalize incompatible laundry ingredients until they are released into the wash solution or dryer. A specially designed substrate may be particularly useful to effect a sequenced delivery in which the detergent and bleach ingredients are released in the wash cycle, a soil release agent is released in the wash and/or rinse cycle and the fabric softener is released in the dryer. The substrate can be used to take almost any physical form including folded and/or laminated pouches, sheets, bags, etc. An example of a particularly useful product form for the present invention is a two-ply multi-pouched laminated article disclosed in allowed U.S. Pat. No. 4,638,907, supra, incorporated herein by reference in its entirety, wherein at least one of the two plies is a reduced pilling, fibrous substrate with a spaced-apart glue pattern adapted to reduce fabric softener staining.

The present invention is preferably used as part of a fully formulated stand-alone laundry product wherein appropriate detergent components are present and released in the wash along with a peroxyacid bleach and a soil release agent and the fabric softener in the dryer. Useful detergent compositions for use with this invention can include essentially any typical laundry detergent containing one or more types of organic surfactant along with detergency adjunct materials. The organic surfactant is selected from the group consisting of anionic, nonionic, ampholytic and zwitterionic surfactants, and mixtures thereof. U.S. Pat. No. 3,664,961, Norris, issued May 23, 1972, incorporated herein by reference, describes at Col. 1, line 68, to Col. 9, line 3, suitable surfactants useful herein. The anionic and nonionic surfactants are preferred. Nonlimiting examples of adjunct materials which can be used in the detergent composition include soil suspending agents, perfumes, optical brighteners, bleaches, processing aids, alkalinity sources and enzymes. Nonlimiting examples of powdered detergent materials suitable for use with the present invention are disclosed in U.S. Pat. No. 4,404,128, B. J. Anderson, issued Sept. 13, 1983, incorporated herein by reference.

The Fabric Softener

The fabric softener of the present invention are loose particles. The softener particle is formulated to survive (i.e., not dissolve in) the wash and rinse cycles, to then melt and become distributed on the washed fabrics in the dryer cycle. The softener particle composition should have a wash water survivability of at least 25%, preferably at least 40% by weight. Numerous examples of softener/antistat compositions which function in this manner are taught in the literature, e.g., U.S. Pat. Nos. 4,113,630, supra, and 4,108,600, supra, which are incorporated herein by reference.

The present invention will be further understood by the following nonlimiting examples.

EXAMPLE I

A preferred particulate fabric softener is one comprising an inner core of solid fabric softener composition surrounded by a water-insoluble coating material which melts or disintegrates in the dryer to release the softener at that stage of the laundering process. A preferred softener composition for the core of such a particle has the following formula:

TABLE 2

| Ingredient | Wt. % |
|---|---|
| Ditallowdimethylammonium methylsulfate (DTDMAMS) | 42.4 |
| Sorbitan monostearate | 21.3 |
| Cetyl alcohol | 21.3 |
| Bentonite clay | 12.0 |
| Perfume | 3.0 |
| Total | 100.0 |

Softener Making Process

Step 1

The DTDMAMS is heated in a reaction vessel at 71° C. under vacuum (Ca. 710 mm Hg) for 4 hours to remove residual moisture and/or isopropanol. The cetyl alcohol and sorbitan monostearate are then added, and the molten "triblend" is mixed for one hour at about 71° C.

The triblend is transferred into a PVM 40 Ross mixer (Charles Ross & Sons Company, Hauppauge, New York 11788). The temperature of the triblend is then raised to 79° C.–85° C. under vacuum (about 330–430 mm Hg). When the temperature has stabilized in this range, the Ross' anchor and disperser are turned on and the clay is added. The mixture is blended for 5 minutes and then sheared with the Ross' colloid mixer for 20 minutes. The perfume is then added and the mixture is blended for 5 minutes with the anchor, disperser and colloid mill still on. The softener composition is then poured into trays and cooled overnight at about 4° C.

Step 2

The solid softener core composition is then converted to particles by milling in a Fitzmill, Model DA506 (The Fitzpatrick Company, Elmhurst, Ill. 60126) at 4740 rpm's through a 4 mesh screen. The particles are then sized through 12 on 30 (U.S. Standard screens, 1.7–0.6 mm particle size).

Step 3

The particles are then coated with a hot melt of fatty alcohol-based coating. The coating is a mixture of 90% stearyl alcohol and 10% Elvax-4310, a terpolymer of ethylene, vinyl acetate and acid from E. I. du Pont de Nemours & Co., Polymer Products Dept., 1007 Market St., Wilmington, Del. 19898. The coating is applied in an 18 inch Wurster coater (Coating Place, Inc., P.O. Box 248, Verona, Wis. 53593). A detailed description of this type of equipment can be found in U.S. Pat. No. 3,196,827, Wurster et al., issued July 27, 1965, incorporated by reference herein.

Briefly, the Wurster Coater consists of an apparatus that is capable of suspending the softener core particles on a rapidly moving warm air stream. Encapsulation is accomplished by passing the softener particles through a zone of finely atomized droplets of coating. As the particles move up and away from the coating nozzle, the coating begins to solidify as the particles cool. When the particles can no longer be fluidized by the air stream, they move down in the opposite direction of the fluidizing air. The coated particles then reenter the coating zone and are recycled until the desired amount of coating is applied. The coating cycle takes place within a single chamber which preferably has a partition to separate the particles moving up through the coating zone from those moving down through the cooling zone.

The following conditions are used to apply a hot melt coating:

| | |
|---|---|
| Stearyl Alcohol/Elvax Temperature | 79° C. |
| Fluidizing Air | 15.8 Cu. M/min. at 40.5° C. |
| Atomizing Air Volume | 0.25 Cu. M/min. |
| Atomizing Air Rate | 4218 g/sq.cm. |
| Inlet Air Temperature | 20° C.–38° C. |
| Outlet Air Temperature | 20° C.–38° C. |
| Pump Rate | 0.2 Kg/min. |
| Nozzle Size | CPI-18-A74* |
| Partition Size | 216 mm × 267 mm |
| Partition Gap | 19 mm |
| Run Time | 22 min. |

*Available from Coating Place, Inc.

The amount of fatty alcohol coating applied to the softener particles is about 15% by weight of the total coated particle. After the coating process is complete the particles are resized through 12 on 20 mesh and are then ready for use "as is" or for blending into detergent and/or bleach granules.

Step 4

Softener core particles prepared as in Step 3 are coated with ethyl cellulose based coating instead of fatty alcohol. The coating is applied by spraying a 10% solids solution in methanol of 9 parts ethyl cellulose and 1 part dibutyl sebacate. The coating is applied in an 18 Inch Wurster coater as described in Step 3. The ethyl cellulose used is Ethocel Std. 4, (Dow Chemical Co., Midland, Mich. 48640) which has an Ubbelhhode viscosity of 3.0–5.5, measured at 25° C. as a 5% solution in 80% toluene/20% ethanol.

The following conditions are used to apply a solvent based coating:

| | |
|---|---|
| Fluidizing Air | 15.8 Cu. M/min. at 40.5° C. |
| Atomizing Air Volume | 0.37 Cu. M/min. |
| Atomizing Air Rate | 5624 g/sq.cm. |
| Inlet Air Temperature | 38° C.–43° C. |
| Outlet Air Temperature | 30° C.–32° C. |

-continued

| | |
|---|---|
| Pump Rate | 0.2 Kg/min. |
| Nozzle Size | CPI-18-A74* |
| Partition Size | 216 mm × 267 mm |
| Partition Gap | 19 mm |
| Run Time | 120 min. |

*Available from Coating Place, Inc.

The amount of ethyl cellulose/dibutyl sebacate solids coated onto the particles is about 5% by weight of the total coated particle weight. When the coating is completed, the softener particles are resized through 12 on 30 Mesh U.S. Standard screens and are then ready for use "as is" or for blending into detergent granules.

Detergent/Softener Composition A

A granular detergent/softener composition is prepared by mixing 4 parts of the above softener particles of either Step 3 or Step 4 with 96 parts of the following granular detergent composition.

The following is a breakdown of the granular detergent component of Composition A.

| | Base Granules Weight % | Grams Final Composition Per Use (Ex. III) |
|---|---|---|
| Sodium $C_{13}$ linear alkylbenzene sulfonate | 22.1 | 5.110 |
| Sodium $C_{14-15}$ alkyl sulfate | 22.1 | 5.110 |
| Sodium silicate (1.6 ratio) | 13.7 | 3.172 |
| Sodium sulfate | 32.2 | 7.455 |
| Polyethylene glycol (MW = 8000) | 1.5 | 0.340 |
| Sodium polyacrylate (MW = 4500) | 2.0 | 0.453 |
| $C_{12-13}$ alcohol polyethoxylate (6) | 3.0 | 0.680 |
| Sodium diethylenetriamine pentaacetate | 1.5 | 0.340 |
| Moisture | 2.0 | 0.462 |
| | | 23.122 |
| Preblend | | |
| Base granules | | 23.122 |
| Sodium tripolyphosphate hexahydrate (powdered) | | 20.576 |
| | | 43.698 |
| Admix | | Grams Final Composition Per Use |
| Preblend | | 43.698 |
| Sodium tripolyphosphate (STP) hexahydrate (granular) | | 19.429 |
| Dye | | 0.003 |
| Brightener | | 0.613 |
| Suds suppressor prill comprising dimethylsilicone, silica, sodium tripolyphosphate and polyethylene glycol (MW = 8000) | | 1.703 |
| Protease | | 2.044 |
| Sodium carbonate | | 4.000 |
| | | 71.490 |
| Spray-on | | |
| Admix | | 71.490 |
| Mineral oil | | 0.710 |
| | | 72.200 |

The base granules are produced by spray-drying an aqueous crutcher mix of the components on a ten foot tower using a crutcher temperature of 200° F., a size 3½ nozzle to make fine granules, and silicone deaerants. A second drying stage on a continuous fluid bed is used to reduce moisture to 2%.

The base granules are then admixed with powdered STP hexahydrate to form the preblend. The preblend is compacted at 50 psig roll pressure on a 4 in. by 10 in. chilsonator, and screened to select a −14 (1168 microns)/+65 (208 microns) particle size cut (Tyler mesh). Oversized particles are collected and granulated on a Fitzmill, Model DA506 (The Fitzpatrick Company, Elmhurst, Ill. 60126), using a 14 mesh screen and low rpm's. This is screened to select a −20(833 microns)/+48(295 microns) particle size cut. Both materials are dedusted by blowing off fines in a fluid bed dryer using ambient air.

The admix is prepared as a 400 pound batch in a drum mixer. Carbonate, granular STP (with dye sprayed-on), brightener, enzymes, and suds suppressor prills are blended with the compacted mainstream product cut and regranulated overs at a ratio of mainstream product cut to overs of about 7 to 1. Mineral oil is sprayed on the final admix in 30 to 40 pound batches at a 1% level using a Forberg Mixer.

Bleach/Softener Composition B

A granular bleach/softener composition is prepared by mixing 4 parts of the above softener particles of either Step 3 or Step 4 with 96 parts of the following granular bleach composition prepared using the procedure described in U.S. Pat. No. 4,374,035, Bossu, issued Feb. 15, 1983 (Example I) incorporated herein reference in its entirety.

| Ingredient | Wt. % |
|---|---|
| Diperoxydodecanedioic acid | 24.0 |
| Dodecanedioic acid | 2.9 |
| Sodium $C_{13}$ linear alkylbenzene sulfonate | 5.5 |
| Boric acid | 27.7 |
| Sodium sulfate | 39.7 |
| Miscellaneous | 0.2 |
| Total | 100.00 |

This Composition B is used at a product level to provide about 10 ppm of available oxygen in an 18-gallon wash (68.1 liters).

EXAMPLE II

A fibrous nonwoven substrate (DuPont REEMAY® 2420, a spunbonded, 63 g/m², 4 denier polyester nonwoven fabric) is printed with a spaced-apart pattern of a hot melt (196°–199° C.) of Henkel 6903 using the following procedure:

Using a Thermo Intaglio Graphics process with a rotogravure hot melt system made by Roto-Therm, Inc., the spaced-apart herringbone glue pattern 12 of FIG. 1 is printed 33 cm wide on a 40 cm wide web of substrate 2420 at a level of about 25 grams per square meter of printed substrate.

An 11.4 cm×28 cm (4.5 in.×11 in.) sheet of the spaced-apart, herringbone glue patterned substrate is cut from the web.

The glue pattern occupies about 16% of the surface of substrate 2420 and the other 84% is unglued surface area 10.

EXAMPLE III

A 6-multi-pouched laundry product consisting of the spaced-apart glue patterned, fibrous nonwoven substrate of Example II containing Detergent/Softener Composition A and Bleach/Softener Granular Composition B is made using the following procedure. The 11.4 cm×28 cm (4.5 in.×11 in.) sheet of Example II is embossed or stretched to form a single row of 6 cells or pouches similar to the one shown in FIG. 4 herein and identified as bleach/softener cells 44 and detergent-/softener cells 46. The spaced-apart printed glue pattern 12 is on the outside surface of this embossed sheet. (For a more detailed description of preferred embossing process see the multi-pouched articles of U.S. Pat. No. 4,571,924, A. S. Bahrani, issued Feb. 25, 1986, incorporated herein by reference in its entirety).

The 6 cells are each embossed to a depth of approximately 1.3 cm (0.5 in.). Each cell is approximately 3.6 cm (1.4 in.) wide and approximately 9.8 cm (3.8 in.) in length, each with about 30 cc capacity. In the embossed "bottom" sheet, two cells 44 on both ends of the sheet are each filled with approximately 14 grams (0.50 oz.) of the granular Bleach/Softener Composition B for a total of 28 grams per 6-multi-pouched product. The remaining four cells 46 are each filled with approximately 18 grams (0.64 oz.) of the granular Detergent/Softener Composition A for a total of 72 grams. An unembossed printed blue patterned substrate (topsheet ply) of Example II is then attached to the filled, embossed ply by heat sealing with a printed thermal set adhesive (HA8661 Coscomelt) patterned (not shown) to correspond to the rims surrounding the 6 cells of the embossed ply for lamination sealing. The spaced-apart printed herringbone glue pattern 12 is on the outside of this unembossed sheet. There are about 3.3 grams of loose softener particles per 6-cell sheet. Substrate pilling of this product is virtually eliminated and the softener staining is reduced (improved) when this product is used in an automatic dryer.

EXAMPLE IV

Same as above except that the product is made with the spaced-apart printed glue pattern 12 assembled on the inside surface of the laminate. Softener staining for this product is improved versus a comparable product made without the glue pattern.

EXAMPLE V

A preferred 6-multi-pouched laundry product is made similar to the one of Example III. In this embodiment a spaced-apart herringbone glue pattern 12 is prined on a Kiara® 9116 (Chicopee) topsheet and the product is assembled with the glue pattern 12 on the inside surface of the product. Also, Borden's HA8661 Coscomelt glue is printed on at about 130° C. and is used for both the spaced-apart glue pattern 12 as well as the lamination sealing adhesive.

The six cells are embossed per 4.5 inch×11 inch (11.4 cm×27.94 cm) sheet, using a "glue-free" Kiara® 9116 substrate. In other words, there is no spaced-apart glue pattern on this embossed sheet.

In view of the above disclosure, one can appreciate that a preferred multi-pouched sheet article like Example V of this invention is almost all that a laundry user would need, for it is designed both for washer and dryer with improved (low) softener staining. It can contain whiteners and stain removers, detergents and softeners to clean, soften, freshen and fight static with reduced staining and improvements over the problems mentioned in the Background.

What is claimed is:

1. A through-the-wash and dryer laundry product comprising:

(a) a water-permeable, water-insoluble substrate;

(b) a particulate fabric softener adapted for release in the dryer upon melting at dryer operating temperatures, said softener enclosed within a pouch made of the substrate; wherein (c) the substrate has on its surface a water-insoluble, spaced-apart glue pattern adapted to reduce fabric softener staining when the product is used in the dryer wherein said glue maintains its integrity through the laudering process and has a solubility in 49° C. water of less than 10%.

2. The laundry product of claim 1 wherein the spaced-apart glue pattern covers from about 1% to about 70% of said substrate surface and is present at a level of about 3 grams to about 150 grams per square meter of said substrate.

3. The laundry product of claim 2 wherein the spaced-apart glue pattern covers from about 5% to about 30% of said substrate surface and said level is 10–50 grams per square meter of substrate.

4. The laundry product of claim 1 wherein said glue pattern is a herringbone spaced-apart pattern.

5. The laundry product of claim 1 wherein said product contains laundering materials selected from antistats, soil release agents, detergents, bleaches, brighteners, enzymes, and combinations thereof.

6. The laundry product of claim 1 wherein said substrate is a fibrous substrate selected from the group consisting of polyesters, polyolefins, cellulose and mixtures thereof.

7. The laundry product of claim 1 wherein said pouch comprises a two-ply laminate made with one ply of a polyester material and a second ply of a cellulosic paper tissue material.

8. The laundry product of claim 1 wherein said glue is selected from the group consisting of polyolefins, polyesters and polyamides.

9. The laundry product of claim 1 wherein said pouch comprises two plies of a nonpilling polyethylene/-polyester substrate with said spaced-apart glue pattern on an inside surface of at least one of said two plies.

10. The laundry product of claim 1 wherein said spaced-apart glue pattern is on an inside surface of at least one of said two plies.

* * * * *